US005280328A

United States Patent [19]

Goto et al.

[11] Patent Number: 5,280,328

[45] Date of Patent: Jan. 18, 1994

[54] IMAGE FORMING SYSTEM HAVING REDUCED WAIT TIME

[75] Inventors: Masahiro Goto; Koichi Suwa, both of Yokohama; Manabu Takano, Machida, all of Japan

[73] Assignee: Canon Kabushiki Kaisha, Tokyo, Japan

[21] Appl. No.: 904,861

[22] Filed: Jun. 26, 1992

[30] Foreign Application Priority Data

Jun. 27, 1991 [JP] Japan ..... 3-181695

[51] Int. Cl.[5] ..... G03G 15/20

[52] U.S. Cl. ..... 355/285; 355/282

[58] Field of Search ..... 355/204, 208, 282, 285, 355/290; 219/216

[56] References Cited

U.S. PATENT DOCUMENTS 4,480,908 11/1984 Anzai ..... 355/285
5,041,718 8/1991 d'Hondt et al. ..... 219/216 X
5,051,780 9/1991 Stelter et al. ..... 355/208
5,081,493 1/1992 Miyasaka ..... 355/208
5,109,255 4/1992 Nishikawa et al. ..... 355/285

FOREIGN PATENT DOCUMENTS 55-31549 2/1980 Japan .

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

An image forming system includes an image former for forming a non-fixed image on a recording sheet, a heat fixer for thermally fixing the non-fixed image on the recording sheet, and an operation permitting signal output device for outputting a signal representative of an operation permitting condition of the image forming system after a power source of the system is turned on. The operation permitting signal output device outputs the signal representative of the operation permitting condition before the temperature of the heating body reaches a waiting temperature.

9 Claims, 6 Drawing Sheets

IMAGE FORMING SYSTEM HAVING REDUCED WAIT TIME

BACKGROUND OF THE INVENTION

1. Field of the Invention

The present invention relates to an image forming system such as a copying machine, printer and the like, having a heat fixing device.

2. Description of the Related Art

In the past, in image forming systems such as electrophotographic recording systems having heat fixing devices, particularly heat roller fixing devices, an operator could not utilize the image forming system until a surface temperature of a heat roller has reached a predetermined level after a power source has been turned ON. Efforts have been made to reduce the waiting time during which the system could not be used after the power source was turned ON. For example, it has been considered to reduce the heat capacity of a heat roller and/or to increase the heating value of a heater for increasing the temperature increasing speed of the heat roller.

However, if the thickness of a roller core made of aluminum and the like is decreased to reduce the heat capacity of the heat roller, heat conduction in a longitudinal direction will be worsened, and further, the heat roller will be more apt to deform from pressure. Furthermore, if the heater is set to compensate for the reduction of the heat conduction, when small-sized recording sheets are printed continuously, since the surface temperature of the portion of the heat roller which does not contact with the recording sheet the, the service life or durability of a separating claw and bearings which contact the heat roller must be increased, thus making the system expensive. Further, since the heat roller is apt to deform, it is not possible to apply adequate force to the heat roller fixing device, thus worsening the fusion of toner on the recording sheet. If the heating value of the heater is increased, since the maximum power consumption is also increased, for example, when a plurality of image forming systems are connected to a power source via a single plug socket, the number of systems to be connected is limited.

Further, as disclosed in the Japanese Utility Model Publication No. 55-31549, it is also known that an image forming operation is started at a temperature lower than a fixing permitting temperature so that the temperature of the heat roller is increased up to the fixing permitting temperature when a recording sheet actually reaches the heat roller fixing device, thereby, reducing the waiting time more or less. However, the time required to bring the recording sheet to the fixing device after the image forming system starts to feed the recording sheet depends upon a length of the sheet feeding path and the sheet feeding speed of the image forming system, and is about 5–10 seconds at the most. Further, since the heat roller is rotating together with a pressure roller when the recording sheet is brought into the fixing device after the sheet feeding operation is started, the building-up temperature of the surface of the heat roller becomes gentle.

Furthermore, since the building-up temperature of the surface of the heat roller is influenced by the dispersion in the input voltage to the heater and/or in the heating value of the heater itself, in order to ensure that the temperature of the heat roller is increased up to the fixing permitting temperature within the time period when the recording sheet reaches the fixing device after the initiation of the sheet feeding operation, the surface temperature of the heat roller at the end of the waiting time must be set to accommodate the condition that the heating value of the heater is lowest, i.e., a condition that the building-up speed of the surface temperature of the heat roller is slowest. Thus, the waiting time cannot be effectively reduced only by ending the waiting time at a temperature lower than the fixing temperature by an amount of the temperature increase until the recording sheet reaches the fixing device.

SUMMARY OF THE INVENTION

An object of the present invention is to provide an image forming system which can reduce the waiting time for making copies once the system is turned on.

Another object of the present invention is to provide an image forming system in which a heating body has a fixing time and a waiting time and which can end the waiting time at a temperature lower than the waiting temperature.

The other objects of the present invention will be apparent from the following detailed description.

DESCRIPTION OF THE PREFERRED EMBODIMENTS

The present invention will now be explained in connection with embodiments thereof with reference to the accompanying drawings.

First of all, a first embodiment of the present invention will be described with reference through FIGS. 1 to 3.

Figure 1:
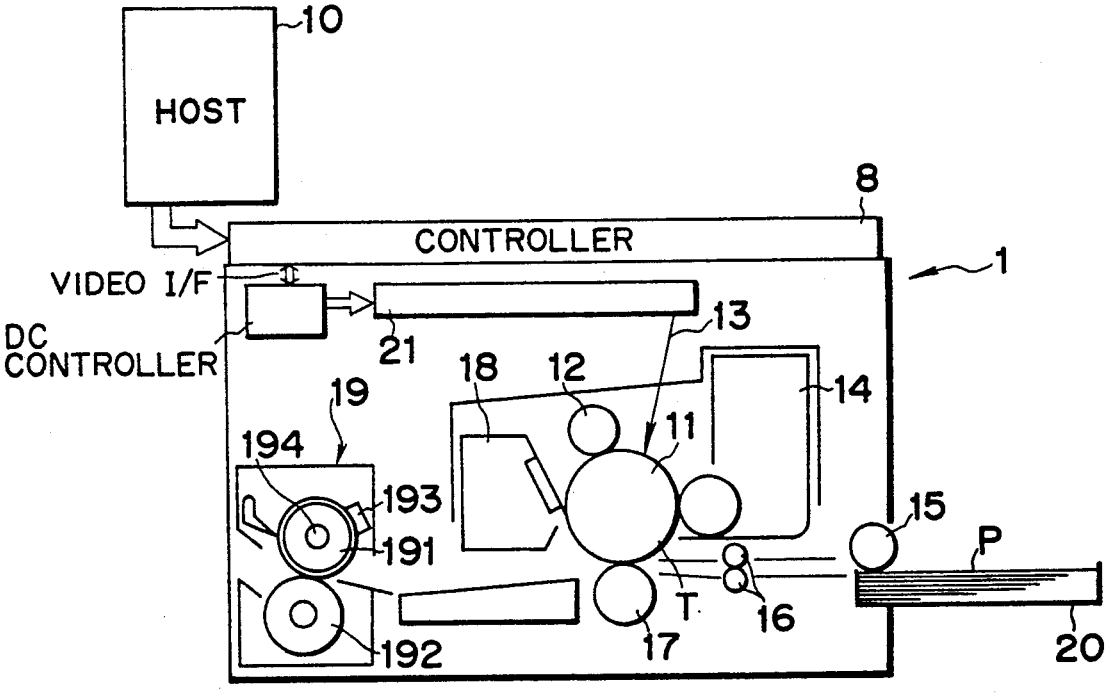
FIG. 1 is an elevational sectional view of an image forming system according to a preferred embodiment of the present invention.
Figure 2:
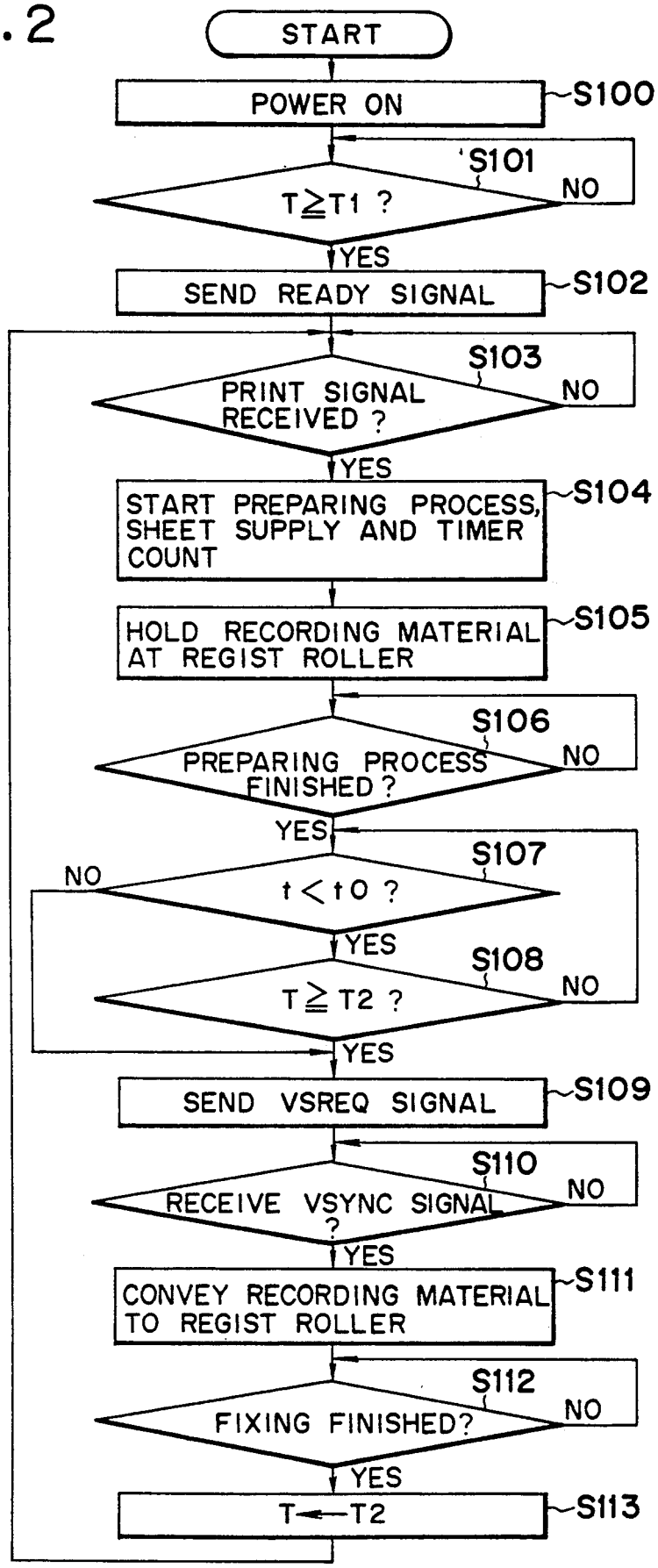
FIG. 2 is a flow chart for a control means of the embodiment of FIG. 1.

FIG. 1 is an elevational sectional view of a laser beam printer as an image forming system according to a first embodiment of the present invention. The laser beam printer 1 according to this embodiment is connected to a host 10 such as a personal computer, a work station and the like so that, after the printer receives image data from the host, the data is developed as bit map data by a controller 8. The image information developed as the bit map data is sent to an engine portion of the laser beam printer 1 via a video interface, and a engine portion forms a desired image by performing the raster scan while modulating a laser beam on the basis of the image information. In this case, the controller and the engine portion of the laser beam printer 1 perform the following communication via the video interface.

First of all, when the engine portion is enabled by a signal from the controller to permit a sheet feeding operation and an operation of the printer, the engine sends a ready signal to the controller. Then, when the controller receives the ready signal from the engine portion, the controller sends a sheet feed command or a print signal to the engine portion. Immediately after the engine portion receives the print signal, the engine portion causes a sheet supply roller 15 to feed out a recording sheet P from a recording sheet containing portion such as a cassette 20, thus sending the recording sheet to a pair of regist rollers 16. The recording sheet P is temporarily stopped at the regist rollers 16 and waits for a condition that the engine portion assumes a print permitting state after the building-up of a scanner 21 and a motor (housed in the scanner) (not shown) and a preliminary rotation (so-called "pre-rotation") of a photosensitive drum 11 for stabilizing the voltage thereof.

When the engine portion assumes the print permitting state, the engine portion sends a vertical synchronous request signal (VSREQ) representative of the permission of the image formation to the controller. When the controller receives such a signal, it sends a vertical synchronous signal (VSYNC) to the engine portion and further sends an image signal (VIDEO) to the engine portion after a predetermined time has elapsed. After receiving the signal VSYNC, the engine portion causes the regist rollers 16 to sent the recording sheet to a transfer portion.

Next, an image forming operation effected at the engine portion of the laser beam printer will be explained.

The photosensitive drum 11 having a photosensitive layer made of organic photo-conductor (OPC) and the like is uniformly charged to a negative polarity by a charger means such as a charger roller 12 and is then illuminated by a laser beam 13 to form a desired electrostatic latent image. The electrostatic latent image is developed by a developing device 14 including negatively charged toner to be visualized as a toner image T. The toner image T is electrostatically transferred onto the recording sheet P by a transfer means such as a transfer roller 17 and the like at the transfer station. Thereafter, the recording sheet P is sent to a heat roller fixing device 19, where the toner image is permanently fixed to the recording sheet. After the transferring operation, the residual toner remaining on the photosensitive drum 11 is removed by a cleaner 18 for preparing for the next image formation.

In the image forming portion, the developing device 14, the charger roller 12, the photosensitive drum 11 and the cleaner 18 are integrally assembled as a cartridge which can be removably mounted within the laser beam printer.

Figure 3:
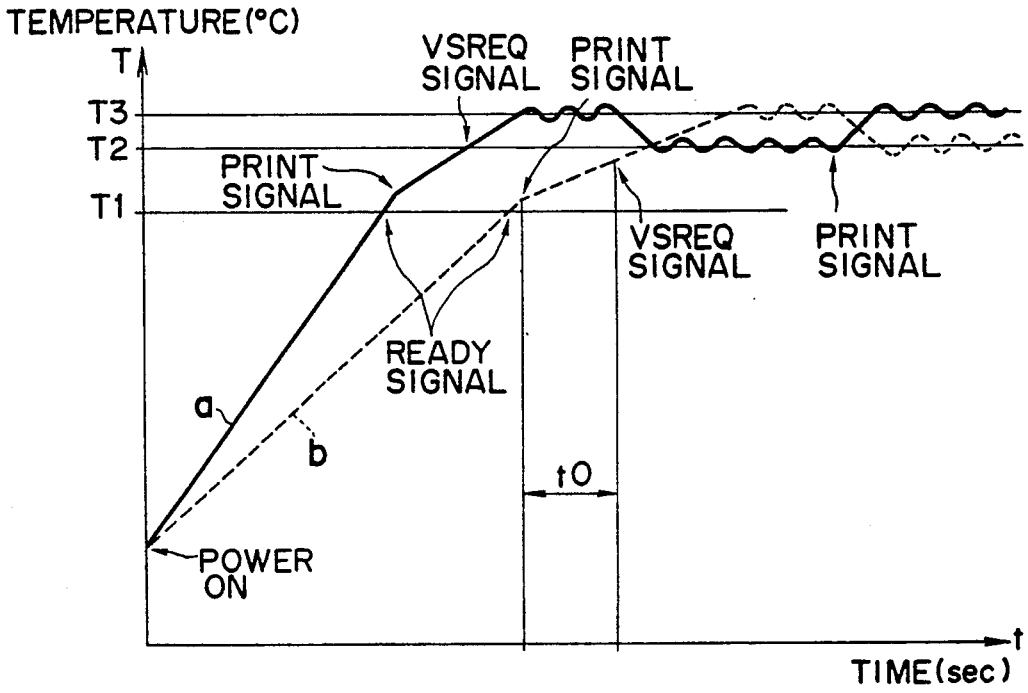
FIG. 3 is the graph showing the timing of input/output of signals associated with a surface temperature of a heat roller and an image forming operation in the embodiment of FIG. 1.

FIG. 3 shows the relation between the change in the surface temperature of a heat roller 191 and time, according to the first embodiment.

Conventionally, when the waiting time T2 for the surface temperature T of the heat roller to reach a fixing temperature while the recording sheet P waits at the regist rollers 16 is reached, a ready signal was emitted.

To the contrary, according to the illustrated embodiment, the ready signal is emitted before the surface temperature T of the heat roller reaches the waiting temperature T2, thus reducing the waiting time.

Emission or sending of the signal VSREQ for starting the subsequent image writing operation is delayed until the surface temperature T reaches the waiting time T2 or until a predetermined time period t0 is elapsed after the reception of the print signal. In this way, it is possible to shorten the time before the emission of the ready signal, without poor fixing occurring.

Now, the reason why the timing of the emission of the signal VSREQ is selected to not only the time when the waiting time T2 is reached but also the time when the predetermined time period has elapsed after the print signal is received is that, even if the building-up temperature of the heat roller 191 is delayed and even if the surface temperature T of the heat roller 191 does not reach the waiting temperature T2, since the surface temperature of the pressure roller rotated together with the heat roller 191 upon receipt of the print signal is adequately increased during the time period t0, poor quality fixing does not occur. Thus, it is possible to reduce the time between the energization of the power source and the initiation of the image writing operation, in comparison with conventional cases.

Next, the control of the engine portion according to the illustrated embodiment will be explained with reference to a flow chart of FIG. 2.

When a power source of the engine portion of the printer is turned ON (step S100), an adjustment of temperature for bringing the surface temperature T of the heat roller toward a setting temperature T2 is started. After such temperature adjustment, it is determined whether the surface temperature T of the heat roller reaches a predetermined temperature T1 lower than the setting temperature T2 or not (step S101). If the surface temperature T reaches the temperature T1, the ready signal is sent or emitted (step S102). Accordingly, in this point, a condition that the print signal from the controller can be received is established.

Now, when the print signal is received (step S103), the preparation for sheet feeding, timer count, pre-rotation and the like is started immediately (step S104), and the recording sheet of recording material P is temporarily stopped at the regist rollers 16 (step S105). Then, it is determined whether the preparing process is finished (for example, the laser scanner is built-up, the light amount adjustment of the laser is finished and the pre-rotation of the photosensitive drum is finished and the like) (step S106).

When the preparing process is finished, it is determined whether the value of a timer exceeds the predetermined time period t0 or not (step S107) or whether the surface temperature T reaches a second setting temperature T2 (step S108), and the signal VSREQ is sent (step S109) at the earlier timing (either "NO" in step S107 or "YES" in step S108). Accordingly, if the surface temperature T has reached the temperature T2, when the print signal is received, the signal VSREQ can be sent immediately after the preparing process has been finished. After the signal VSREQ has been sent, upon the receipt of the signal VSYNC (step S110), the regist rollers 16 are rotated to feed the recording sheet to the transfer portion (step S111). When the fixing operation is finished (step S112), the surface temperature T is set to the temperature T2 (step S113) and a new print signal is awaited (step S103).

Next, the result of tests wherein a process speed was 50 mm/sec, a sheet (of A4 size) feeding speed was 8 sheets/min, the maximum width of passable sheet was LTR size (216 mm in width), an outer diameter of the heat roller was 25 mm, a thickness of aluminium as the core was 1.6 mm and the heating value of a heating halogen heater was 400 W (in 100 V power) by using the image forming system according to the illustrated embodiment will be described with reference to FIG. 3.

In FIG. 3, a solid line a indicates the change in the surface temperature T of the heat roller when the rated voltage of 100 V is applied to the printer. As shown in FIG. 3, the temperature T1 which is a reference value when the ready signal is sent is set to have a value lower than the temperature T2, so that the ready signal is sent at a time earlier than conventional cases. In the example shown by the solid line a, the print signal is sent from the controller immediately after the ready signal has been sent from the engine portion. Thus, the timer count is started from this point, and it is determined whether the temperature T2 is reached or whether the value t of the timer count exceeds a predetermined time t0, after the preparing process has been finished. The example shown by the solid line a is an example that the temperature T2 was reached before the predetermined time period t0 elapsed, and at this point, the signal VSREQ was sent from the engine portion.

Thus, in comparison with the conventional cases in which the ready signal is sent after the surface temperature T had reached the temperature T2, according to the illustrated embodiment, it is possible to reduce the time period until the signal VSREQ is sent, by the amount of time required to finish the preparing process after the print signal is received Thereafter, the surface temperature of the heat roller is maintained at the fixing permitting temperature T3, and is lowered to the waiting temperature T2 after the fixing operation.

On the other hand, an example shown by a broken line b indicates the case where a voltage (90 V in this example) lower than the rated voltage was applied to the printer. Also in this case, although the print signal is sent immediately after the ready signal was sent, since the building-up of the temperature is slow, the timer value t exceeds the predetermined time t0 before the temperature T2 is reached. Thus, the signal VSREQ is sent when the predetermined time t0, elapses after the print signal is received. As shown in FIG. 3, although the surface temperature T of the heat roller has not reached the temperature T2, since the heat roller and the pressure roller are rotated after the print signal is received, the pressure roller is heated during the predetermined time period t0 so that the temperature of the whole fixing device is maintained so not to cause the poor fixing. Accordingly, in comparison with the conventional cases in which the ready signal and the signal VSREQ are not sent until the temperature T2 is reached, it is possible to reduce the time period until the signal VSREQ is sent.

Incidentally, in the above-mentioned test example, the temperatures T1, T2 and T3 were set to 155° C., 170° C. and 180° C., respectively, and the time period t0 was set to 10 seconds. The setting of these values is based on the fact that, as mentioned above, the temperature T3 must be maintained to ensure sufficient fixing ability of the toner and the temperature T2 must be set to a temperature capable of increasing the surface temperature of the heat roller from the temperature T2 to or near the temperature T3 until the recording sheet reaches the fixing portion after the initiation of the sheet feeding. The temperature T1 is set so that it is increased near the temperature T2 within the time period t0 from the initiation of the sheet feeding. On the other hand, the time period t0 is desired to be as short as possible because the number of revolutions of the photosensitive, drum may be reduced as much as possible and the first print time after the sending of the ready signal may be not so long as to cause operator anxiety, and is preferably selected to be within 5 - 20 seconds, also in consideration of the adequate heating of the pressure roller.

Further, preferably, the relation between the temperatures T1, T2 and T3 is selected to satisfy the requirement $(T2-T1)>(T3-T2)$ in order to reduce the time period until the printer sends the ready signal as long as possible and to ensure sufficient fixing ability. The reason is that, although the difference in temperature between the temperatures T2 and T3 is determined by the time required to feed the recording sheet from the sheet supply portion to the fixing portion and the building-up of the surface temperature of the heat roller, since the building-up of the surface, temperature of the heat roller is influenced by the input voltage to the printer and the like as mentioned above, the temperatures difference between the temperature T2 and T3 must be determined on the basis of the smallest inclination of the building-up of the surface temperature of the heat roller in order to ensure good fixing ability of the system under various circumstances or conditions. Thus, it is preferable that the temperature difference between the temperatures T2 and T3 is not too great. On the other hand, as to the difference in temperature between the temperatures T1 and T2, since the recording sheet is temporarily stopped at the regist rollers and the surface temperature T of the heat roller and the time elapsed from the initiation of the sheet feeding are monitored so that the waiting time at the regist rollers can be varied in accordance with the inclination of the building-up of the surface temperature of the heat roller and the pressure roller can be heated adequately, it is possible to ensure the fixing ability of the system even when the inclination of the building-up of the surface temperature of the heat roller is relatively small. Thus, the temperature difference between the temperatures T1 and T2 can be relatively large, and therefore, it is possible to reduce the time period until the printer sends the ready signal, by decreasing the temperature T1 as long as possible.

As mentioned above, according to the first embodiment of the present invention, even when the input voltage is low to reduce the heating value of the heater 194 and thus to delay the building-up of the surface temperature T of the heat roller, since the waiting is effected at the regist rollers until the surface temperature T of the heat roller reaches the predetermined temperature, it is possible to prevent poor fixing of the image even when the first setting temperature T1 is lowered considerably. As a result, it is possible to reduce the time period until the engine portion of the printer sends the ready signal. Further, even if the surface temperature T of the heat roller does not reach the second setting temperature T2 when the time t from the emission of the print signal is counted and the recording sheet is at the regist rollers, the signal VSREQ is emitted after the predetermined time period t0 elapses to start the printing operation, and the recording sheet is sent from the regist roller to the transfer portion. Thus, even if the building-up of the surface temperature of the heat roller is slow, it is possible to prevent the photosensitive drum 11 from rotating for a long time, and further, even if the feeding of the recording sheet is started while the surface temperature of the heat roller is lower than the second setting temperature T2, since the heat roller 191 is rotated for the predetermined time period, the pressure roller 192 can be heated adequately, thus preventing poor fixing of the image. The reduction of the unnecessary rotations of the photosensitive drum 11 is particularly effective when the printer utilizes a cartridge including a photosensitive drum having a short service life.

Further, when the heat roller 191 is in the first setting temperature T1, the ready signal is sent, and thereafter, the heat roller is heated up to the second setting temperature T2 regardless of the presence of the print signal. And, during the waiting condition, the heat roller is maintained at the second setting temperature T2. In the subsequent sequence, regardless of the surface temperature T of the heat roller, the signal VSREQ can be sent in response to the print signal. Accordingly, the first print time is not extended except when the print signal is received immediately after the ready signal is sent.

Further, in the laser beam printer according to this embodiment, since the wait time until the image data is sent from the host to the controller after the power is turned ON can be reduced by sending the ready signal earlier, it is possible not only to output the printed image from the printer to the operator of the host earlier but also to release the host from the print waiting condition earlier.

Furthermore, according to this embodiment, even if the input voltage to the printer is varied to change the heating value of the heater, it is possible to provide a stable fixing ability, and to reduce the time period until the ready signal is sent without increasing the power consumption of the heater. More particularly, if such a sequence is not used (i.e., the ready signal is sent at the temperature T2) in the fixing device according to the illustrated construction, a heater having 550 Watt power (at 100 V) is required to build-up the heat roller within the same time period as the illustrated embodiment. Accordingly, by using the sequence according to the illustrated embodiment, it is possible to save electric power of the order of 150 W. In the present embodiment, the maximum power consumption of the printer is determined by how to limit the wait time within a predetermined time range, i.e., how to set the building-up temperature of the heat roller. Thus, since the wait time can be reduced without increasing the power consumption by using the illustrated sequence, it is possible to reduce the maximum power consumption of the printer.

Next, a second embodiment of the presnet invention will be explained with reference to FIGS. 4 and 5. Incidentally, the same constructural elements as those of the first embodiment are designated by the same reference numerals and the detailed explanation thereof will be omitted.

Figure 4:
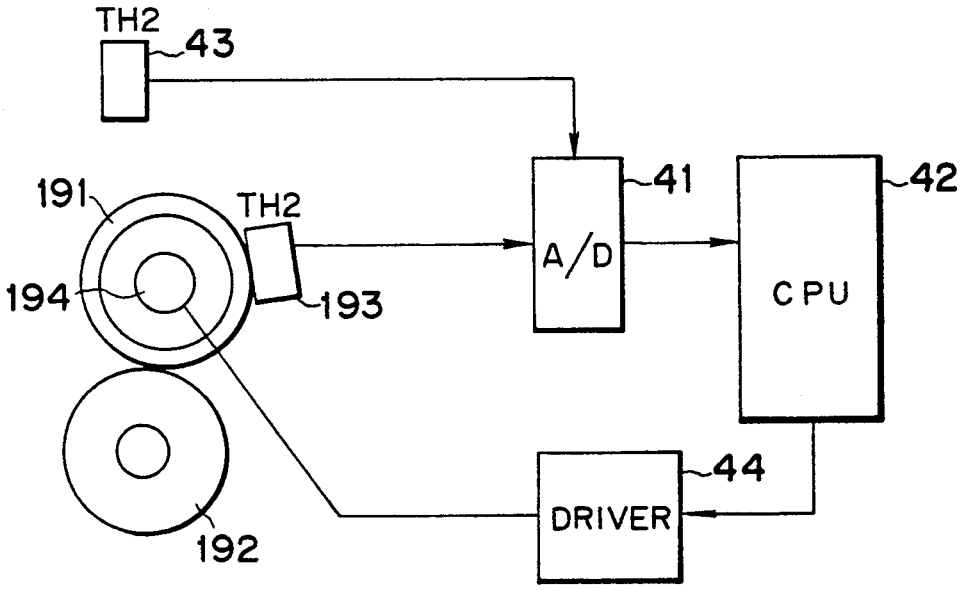
FIG. 4 is a block diagram showing a schematic view of the main construction of an image forming system according to a second embodiment of the present invention.
Figure 5:
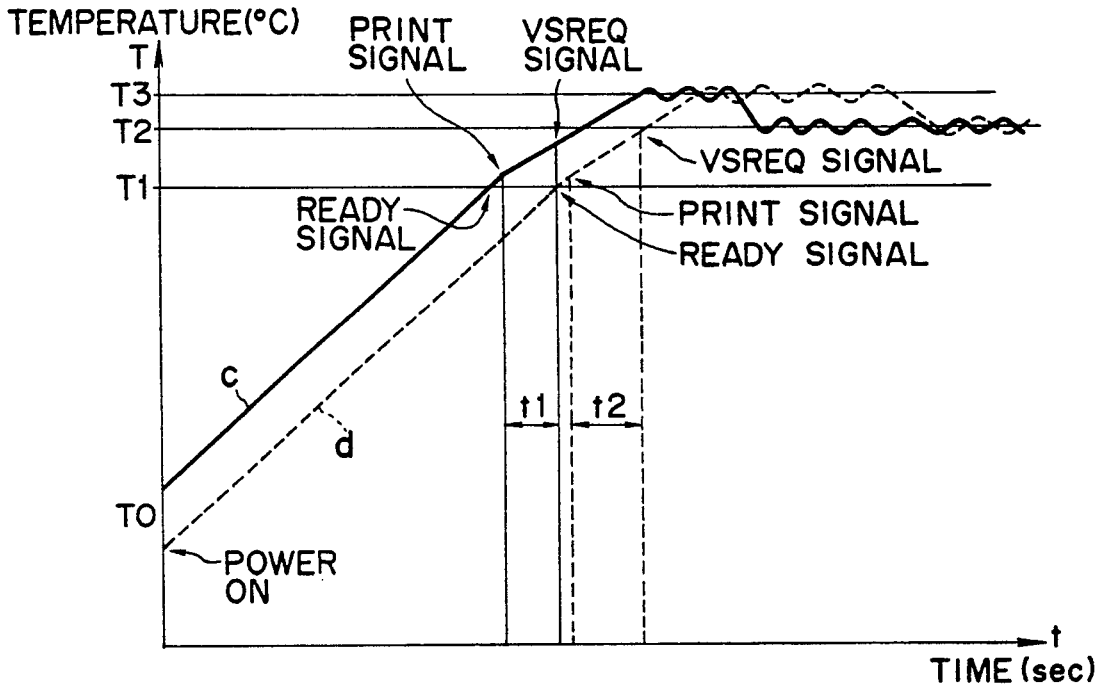
FIG. 5 is a graph showing the timing of input/output of signals associated with the surface temperature of a heat roller and an image forming operation in the second embodiment.

FIG. 4 is a block diagram showing the schematic construction of an image forming system according to the second embodiment of the present invention, and FIG. 5 is a graph showing the timing of input/output associated with the image forming operation and the change in the surface temperature of the heat roller under the temperature control effected by the second embodiment.

In this second embodiment, as shown in FIG. 4, a signal from a thermistor 193 (TH1) for adjusting the temperature of the heat roller is inputted to a CPU 42 via an A/D converter 41, and the heater 194 is intermittently driven by controlling a driver 44 by means of the CPU 42 to control the surface temperature of the heat roller at a predetermined temperature. Further, the ready signal sending sequence and the VSREQ signal sending sequence are switched by a signal from an atmospheric temperature detecting thermistor 43 (TH2) disposed within the printer (for example, on a substrate of a printer DC ontroller). More particularly, as the power source of the printer is turned ON, when the atmospheric temperature detected by the thermistor 43 is greater than T0° C., the maximum waiting time of the recording sheet at the regist rollers is selected to be 1 second as mentioned in connection with the first embodiment, and, when the atmospheric temperature is smaller than T0° C., the maximum waiting time of the recording sheet at the regist rollers is selected to be 2 seconds longer than 1 second. This relation is shown in graph of FIG. 5.

A solid line c indicates the temperature control when the detected atmospheric temperature is greater than T0° C. upon energization of the printer, and a broken line d indicates the temperature control when the detected atmospheric temperature is smaller than T0° C. In this case, the input voltage to the printer is set to have a value of 90% of the rated voltage to delay the building-up of the surface temperature of the heat roller. As a result, FIG. 5 shows an example in which, when the surface temperature T of the heat roller reaches a temperature T1° C., the ready signal is sent, and when the print signal is received immediately, thereafter, the surface temperatures T do not reach the temperature T2° C. within predetermined time periods t1 sec and t2 sec, respectively. Accordingly, in the control operation shown by the solid line c, the signal VSREQ is sent when the time t1 sec has elapsed after the print signal is received; whereas, in the control operation shown by the broken line d, the signal VSREQ is sent when the time t2 sec has elapsed after the print signal is received.

In this second embodiment, the same heat fixing device as that of the first embodiment was used, and the temperatures T1, T2, T3 were set to have values of 155° C., 170° C., 180° C., respectively, and the times t1, t2 were set to have values of 7 seconds and 12 seconds, respectively. Further, the atmospheric temperature T0 for switching the sequences was set to 18° C. With this arrangement, it is possible to hold the recording sheet at the regist rollers for a time sufficient to adequately heat the heat roller and the pressure roller under a cold atmospheric temperature requiring a severe fixing condition, and to reduce the waiting time for providing the printed image to the operator earlier under a hot atmospheric temperature not requiring the severe fixing condition.

In this second embodiment, while the waiting time is switched in two stages in response to the atmospheric temperature, it may be switched in more stages in response to the atmospheric temperature, and the surface temperature T1 of the heat roller at which the ready signal is sent may be switched in response to the atmospheric temperature. Also in these cases, the same advantages can be expected.

Next, a third embodiment of the present invention will be explained with reference to FIG. 6. Incidentally, the same constructural elements as those of the first embodiment are designated by the same reference numerals and the detailed explanation thereof will be omitted.

Figure 6:
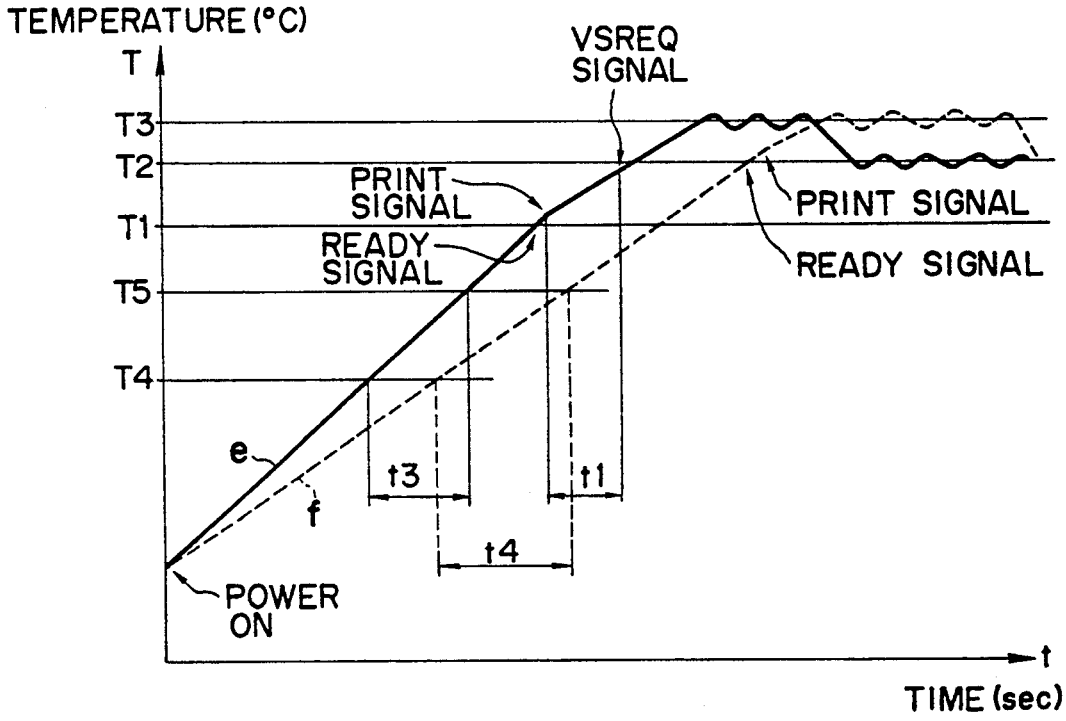
FIG. 6 is a graph showing the timing of input/output of signals associated with the surface temperature of a heat roller and an image forming operation in a second embodiment of the present invention.

FIG. 6 is a graph showing the sending timing of the ready signal and the signal VSREQ and the change in the surface temperature of the heat roller, according to a third embodiment of the present invention. In this embodiment, the inclination of the building-up of the surface temperature of the heat roller after the power is turned ON is monitored, and, if the building-up temperature is too slow, the temperature at which the printer sends the ready signal is switched or altered. More particularly, the heat fixing device is same as those of the first and second embodiments, the temperatures T1, T2, T3 are set to 155° C., 170° C., 180° C., respectively, the time period when the surface temperature of the heat roller after the power ON increases from a temperature T4° C. up to a temperature T5° C. is counted, and the inclination of the building-up of the surface temperature of the heat roller is detected. In this case, the temperatures T4 and T must be selected within the temperature range within which the thermistors can detect the temperature with high accuracy, and are preferably selected within a temperature below the temperature T1 at which the ready signal is sent above 100° C. In this third embodiment, the temperatures T4, T5 were set to 110° C., 130° C., respectively. Accordingly, the inclination of a solid line e becomes 20/t3 (°C./sec) and the inclination of a broken line f becomes 20/t4 (°C./sec). In this embodiment, when these inclination values are greater than predetermined values, the ready signal is sent at the temperature T1 as in the first embodiment and the recording sheet waits at the regist rollers, and, when the temperature reaches the value T2 or when the time period t1 (sec) elapses after the sending of the print signal (either earlier one), the signal VSREQ is send to start the printing operation.

On the other hand, when the above-mentioned inclination values are below the predetermined values, the printer does not send the ready signal at the temperature T1, but sends such signal when the temperature T2 is reached. The subsequent sequence is the same as that of the first embodiment, since the heat roller is already increased to the temperature T2.

In this embodiment, the solid line e indicates the building-up of the temperature when the input voltage is 90 V and the heating value of the heater is 400 W (at 100 V); whereas, the broken line f indicates the building-up of the temperature when the input voltage is 85 V and the heating value of the heater is 370 W (at 100 V). Further, the inclination for switching the sequences was selected to be 2.5° C./sec.

With the arrangement according to the third embodiment, since, when the building-up of the surface temperature of the heat roller is too slow, the ready signal is sent after the surface temperature reaches the waiting or stand-by temperature T2, it is possible to ensure good fixing ability of the image. As a result, the wait time t1 can normally be set to be relatively short. When the input voltage is considerably small or when the input voltage is lower than the rated value of the lower rated limit of the heating value of the heater (which are rare cases), a good fixing ability for fixing the image can be maintained by extending the wait time. Consequently, the ready temperature T1 and the wait time t1 can be set without considering such rare cases, and thus, it is possible to reduce the ready temperature T1 and the wait time t1, thereby reducing the print permitting waiting time and providing the printed image earlier.

As mentioned above, according to the present invention, the signal enabling the receipt of the image formation start request signal is emitted when the surface temperature of the heat roller after the power ON reaches the setting temperature below the waiting temperature, and, if the start request signal is received before the surface temperature reaches the waiting temperature, when the surface temperature reaches the waiting temperature or when the predetermined time period elapses after the receipt of the start request signal (either earlier one), the output request signal for the image data is emitted. Thus, it is possible to reduce the waiting time while ensuring good fixing ability under various circumstances, without increasing the heating value of the heater and/or decreasing the heat capacity of the heat roller. When the present invention is particularly applied to a laser beam printer connected to a host device, it is possible to release the host from the print waiting condition earlier.

While the present invention was explained with reference to the particular embodiments, it should be noted that the present invention is not limited to such embodiments, and various alterations and modifications can be adopted within the spirit of the invention.

What is claimed is:

1. An image forming system, comprising:

image forming means for forming a non-fixed image on a recording sheet;

heat fixing means for thermally fixing the non-fixed image on the recording sheet, said heat fixing means having a heating body maintained at a predetermined temperature and temperature adjusting means for adjusting the temperature of said heating body, said temperature adjusting means adjusting the temperature of said heating body to a fixing temperature during a fixing operation and to a waiting temperature lower than the fixing temperature during a waiting condition;

operation permitting signal output means for outputting a signal representative of an operation permitting condition of said image forming system after a power source thereof is turned on, wherein said operation permitting signal output means outputs the signal representative of the operation permitting condition before the temperature of said heating body reaches the waiting temperature; and determining means for determining whether said heating body reaches the waiting temperature after an image formation preparing process is finished, and whether a predetermined time has elapsed after the image formation preparing process has started.

2. An image forming system according to claim 1, wherein said operation permitting signal output means outputs the signal representative of the operation permitting condition before the temperature of said heating body reaches a predetermined temperature lower than the waiting temperature.

3. An image forming system according to claim 1, wherein said image forming system performs an image formation preparing process upon receipt of an image formation start signal.

4. An image forming system according to claim 1, wherein said image forming system performs an operation for image formation at a time selected from the earlier one of the time when said heating body reaches the waiting temperature and the time when the predetermined time has elapsed.

5. An image forming system according to claim 4, wherein said image forming system further comprises a printer for forming an image on the basis of received image data, and sending a synchronous request signal as the operation for the image formation.

6. An image forming system according to claim 1, wherein said image forming means comprises an image bearing member for bearing the non-fixed image thereon, and transfer means for transferring the non-fixed image onto the recording sheet.

7. An image forming system according to claim 1, wherein said heating body comprises a heat rotary member heated by a heating source.

8. An image forming system according to claim 7, wherein said heat fixing means further comprises a back-up rotary member to cooperate with said heat rotary member for forming a nip therebetween.

9. An image forming system according to claim 8, wherein said heat rotary member and said back-up rotary member are rotated upon receipt of an image formation start signal.

* * * * *

UNITED STATES PATENT AND TRADEMARK OFFICE

CERTIFICATE OF CORRECTION

PATENT NO. : 5,280,328

DATED : January 18, 1994

INVENTOR(S) : MASAHIRO GOTO, ET AL.

It is certified that error appears in the above-indentified patent and that said Letters Patent is hereby corrected as shown below:

Column 1,
Line 33, "the," should read --increases,--; and
Line 51, "thereby," should read --thereby--.

Column 2,
Line 55, "through" should read --to--;
Line 56, "to" should read --through--;
Line 66, "a" (second occurrence) should read --the--; and
Line 67, "the" should read --a--.

Column 3,
Line 31, "sent" should read --send--.

Column 4,
Line 3, "time" should read --temperature--.

UNITED STATES PATENT AND TRADEMARK OFFICE

CERTIFICATE OF CORRECTION

PATENT NO. : 5,280,328
DATED : January 18, 1994
INVENTOR(S) : MASAHIRO GOTO, ET AL.

It is certified that error appears in the above-indentified patent and that said Letters Patent is hereby corrected as shown below:

Column 6,
Line 3, "tive," should read --tive--; and
Line 18, "surface," should read --surface--.

Column 9,
Line 30, "send" should read --sent--.

Column 10,
Line 61, "one" should be deleted.

Signed and Sealed this

Sixth Day of September, 1994

Bruce Lehman

*Attest:*

BRUCE LEHMAN

*Attesting Officer*

*Commissioner of Patents and Trademarks*